US011709459B2

(12) United States Patent
Mitorida

(10) Patent No.: US 11,709,459 B2
(45) Date of Patent: Jul. 25, 2023

(54) EXHAUST DEVICE AND IMAGE FORMING APPARATUS

(71) Applicant: FUJIFILM Business Innovation Corp., Tokyo (JP)

(72) Inventor: Shinya Mitorida, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/567,333

(22) Filed: Jan. 3, 2022

(65) Prior Publication Data

US 2023/0064135 A1 Mar. 2, 2023

(30) Foreign Application Priority Data

Aug. 25, 2021 (JP) ..... 2021-137610

(51) Int. Cl.
*G03G 21/00* (2006.01)
*G03G 21/20* (2006.01)
*G03G 15/02* (2006.01)

(52) U.S. Cl.
CPC ..... *G03G 21/206* (2013.01); *G03G 15/0258* (2013.01); *G03G 2221/1645* (2013.01)

(58) Field of Classification Search
CPC ..... G03G 15/0258; G03G 21/206; G03G 2221/1645
USPC ..... 399/92, 93
See application file for complete search history.

(56) References Cited

U.S. PATENT DOCUMENTS 5,081,496 A * 1/1992 Takeda ..... G03G 15/0216 399/92
5,307,132 A * 4/1994 Tsuchiya ..... G03G 15/2003 399/92
6,141,512 A * 10/2000 Nagano ..... G03G 21/1814 399/92
6,173,132 B1 * 1/2001 Kida ..... G03G 21/0005 399/92
2006/0083666 A1 * 4/2006 Katayama ..... G03G 21/206 422/177
2012/0177396 A1 * 7/2012 Pitas ..... G03G 21/206 399/93
2012/0243899 A1 * 9/2012 Ryuzaki ..... G03G 21/206 399/92

(Continued)

FOREIGN PATENT DOCUMENTS

JP 2006-240198 A 9/2006
JP 2010-234743 A 10/2010

*Primary Examiner* — Robert B Beatty
(74) *Attorney, Agent, or Firm* — Oliff PLC

(57) ABSTRACT

An exhaust device includes: a flow path section through which gas containing ozone generated inside a device body flows; a joint section connected to the flow path section with an inlet opening where hot gas generated inside the device body flows, and where gas containing ozone and hot gas are joined internally; a first air flow generator that generates an air flow which causes the gas containing ozone to flow through the flow path section and to the joint section; and a second air flow generator that causes the gas containing ozone and the hot gas to be joined and discharged from the joint section to outside the device body so that a flow rate of the joint gas discharged from the joint section to outside the device body is higher than a flow rate of the gas containing ozone to the joint section by the first air flow generator.

8 Claims, 11 Drawing Sheets

(56) References Cited

U.S. PATENT DOCUMENTS

| | | | | |
|---|---|---|---|---|
| 2015/0168913 | A1* | 6/2015 | Yamaguchi | G03G 21/206 399/92 |
| 2020/0050144 | A1* | 2/2020 | Kabata | G03G 21/206 |

* cited by examiner

EXHAUST DEVICE AND IMAGE FORMING APPARATUS

CROSS-REFERENCE TO RELATED APPLICATIONS

This application is based on and claims priority under 35 USC 119 from Japanese Patent Application No. 2021-137610 filed Aug. 25, 2021.

BACKGROUND

(i) Technical Field

The present disclosure relates to an exhaust device and an image forming apparatus.

(ii) Related Art

The printing device described in Japanese Unexamined Patent Application Publication No. 2006-240198 includes: a blanket cylinder; a paper discharge cylinder in which a chain for discharging a printed printing sheet to a discharge section is wound over a sprocket; an imager; a dryer that dries the printing sheet transported by the chain; and a heat dissipator that dissipates and discharges an air flow of the heat given to the print sheet by the dryer.

SUMMARY

A gas containing ozone may be generated inside the device body. When a heat source is provided inside the device body, a configuration may be adopted in which a hot gas generated by heating air by the heat source and the gas containing ozone are joined and discharged to the outside of the device body.

In this configuration, the flow rate of the hot gas discharged to the outside of the device body may be higher than the flow rate of the gas containing ozone discharged to the outside of the device body. When a hot gas is joined to a flow path, at an intermediate point thereof, for discharging the gas containing ozone to the outside of the device body, the flow of the gas containing ozone may be disturbed, and the gas containing ozone may stagnate inside the device body.

Aspects of non-limiting embodiments of the present disclosure relate to inhibiting the gas containing ozone from stagnating inside the device body, as compared with a configuration in which a hot gas is joined to a flow path, at an intermediate point thereof, for discharging the gas containing ozone to the outside of the device body.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an exhaust device including: a flow path section through which a gas containing ozone generated inside a device body flows; a joint section which is connected to the flow path section, and has an inlet opening into which a hot gas generated inside the device body flows, the joint section being a section where a gas containing ozone and the hot gas are joined internally; a first air flow generator that generates an air flow which causes the gas containing ozone to flow through the flow path section and flow out to the joint section; and a second air flow generator that generates an air flow which causes a joint gas in which the gas containing ozone and the hot gas are joined to be discharged from the joint section to an outside of the device body so that a flow rate of the joint gas discharged from the joint section to the outside of the device body is higher than a flow rate of the gas containing ozone flowing out to the joint section by the first air flow generator.

BRIEF DESCRIPTION OF THE DRAWINGS

Exemplary embodiments of the present disclosure will be described in detail based on the following figures, wherein.

DETAILED DESCRIPTION

Figure 1:
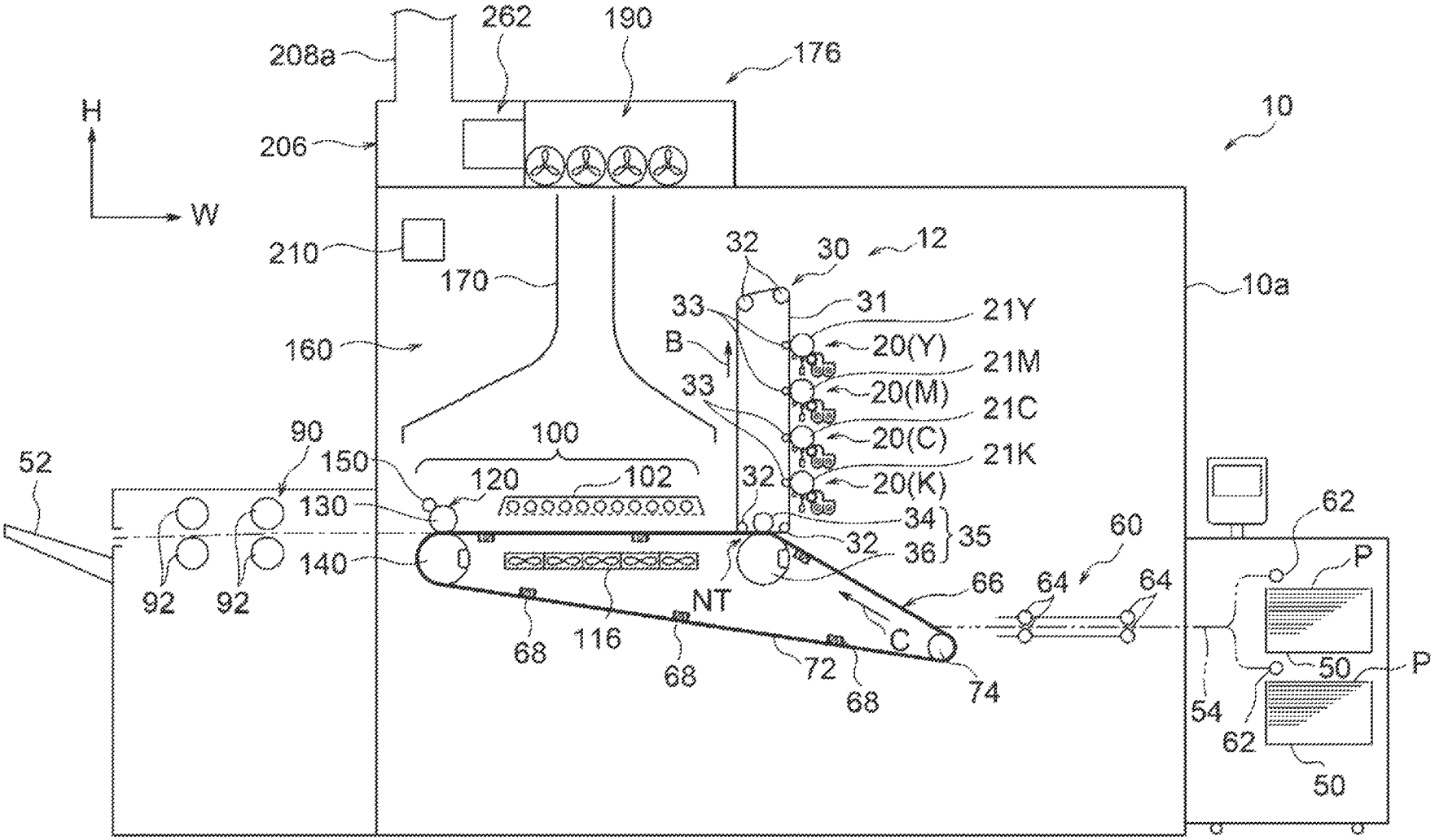
FIG. 1 is a schematic configuration view illustrating an image forming apparatus according to an exemplary embodiment of the present disclosure.

Examples of exhaust device and image forming apparatus according to an exemplary embodiment of the present disclosure will be described with reference to FIGS. 1 to 11. Note that in the drawings, arrow H indicates a device up-down direction (vertical direction), arrow W indicates a device width direction (horizontal direction), and arrow D indicates a device depth direction (horizontal direction). In addition, the device width direction and the device depth direction are perpendicular to each other.

Image Forming Apparatus 10

As illustrated in FIG. 1, an image forming apparatus 10 is an electrophotographic image forming apparatus that forms a toner image on a sheet member P as an example of a recording medium. The image forming apparatus 10 includes a storage unit 50, a discharge unit 52, an image former 12, a transport mechanism 60, a fixing section 100, a cooler 90, an exhaust device 160, and a control device 210.

Storage Unit 50, Discharge Unit 52

As illustrated in FIG. 1, the storage unit 50 is disposed at a portion on one side of a device body 10*a* in the device width direction, and is made drawable from the device body 10*a*. Furthermore, two storage units 50 are provided side by side in the device up-down direction. Sheet members P of different sizes are stored in respective storage units 50.

The discharge unit 52 is disposed at a portion on the other side of the device body 10*a* in the device width direction, and configured to discharge sheet member P on which a toner image is formed.

Cooler 90

As illustrated in FIG. 1, the cooler 90 is disposed on one side of the discharge unit 52 in the device width direction, and includes a pair of cooling rolls 92 arranged side by side in the device width direction.

Each cooling roll 92 is configurated by a cylindrical roll made of metal. The cooling roll 92 allows air to flow inside thereof.

In this configuration, the cooler 90 cools the sheet member P heated by the fixing section 100 through heat exchange with the flowing air. Furthermore, the cooler 90 discharges the cooled sheet member to the discharge unit 52.

Image Former 12

As illustrated in FIG. 1, the image former 12 is disposed between the storage unit 50 and the cooler 90 in the device width direction. The image former 12 includes a toner image former 20 that forms a toner image, and a transfer device 30 that transfers the toner image formed by the toner image former 20 to the sheet member P.

Toner Image Former 20

As illustrated in FIG. 1, multiple toner image formers 20 are provided to form a toner image for each color. The image forming apparatus 10 includes the toner image formers 20 for a total of four colors: yellow (Y), magenta (M), cyan (C), and black (K).

The toner image formers 20 for four colors are disposed side by side from the upper side to the lower side in the order of yellow (Y), magenta (M), cyan (C) and black (K) from the upstream side in a circumferential direction (arrow B direction in FIG. 1) of the transfer belt 31 (the details will be described below).

Figure 2:
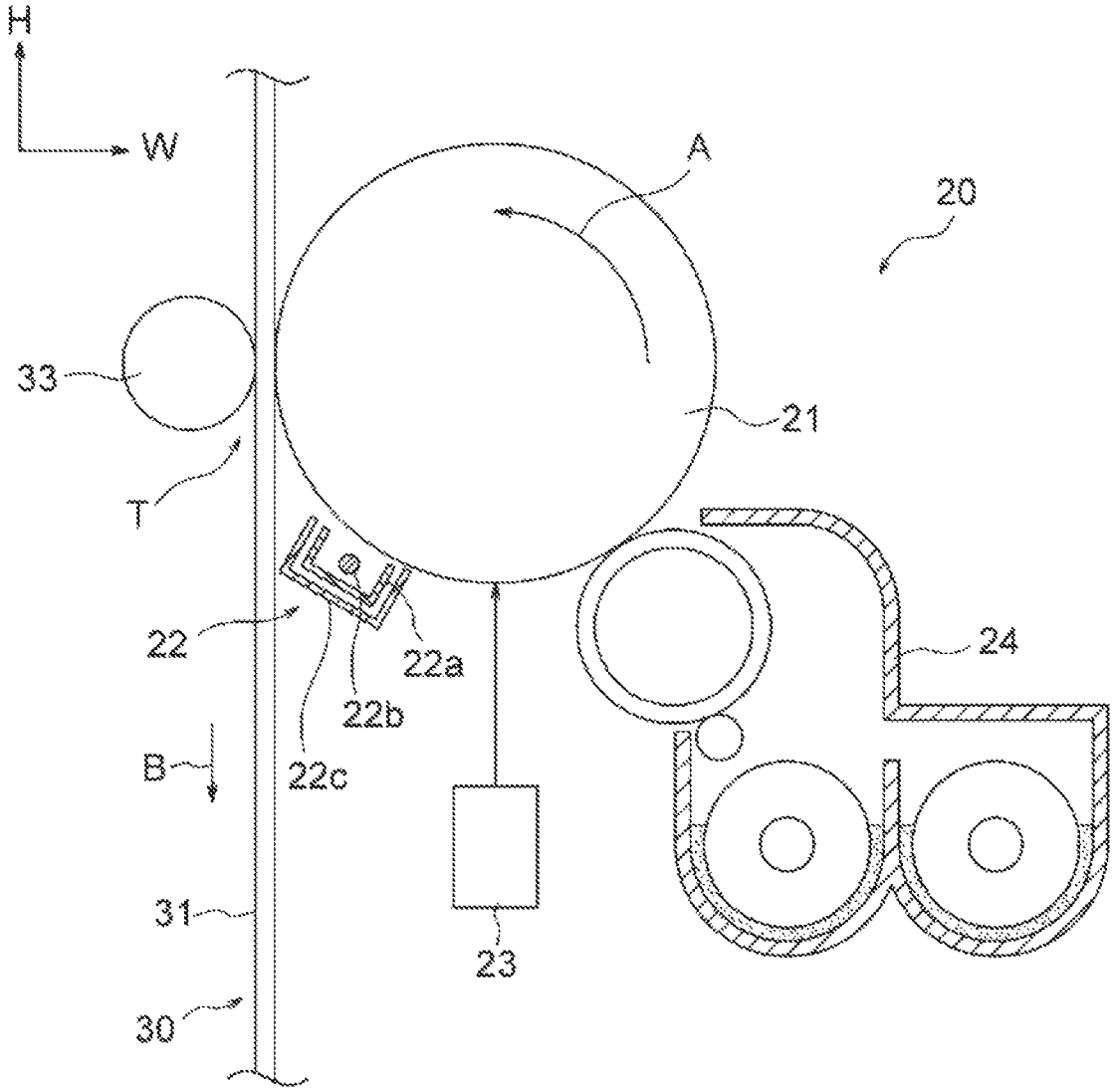
FIG. 2 is a configuration view illustrating a toner image former included in the image forming apparatus according to the exemplary embodiment of the present disclosure.

The toner image formers of all colors are basically configurated in the same manner except for the toner to be used. Specifically, as illustrated in FIG. 2, the toner image former 20 for each color includes an image carrier 21 (=photoconductor) that rotates in arrow A direction in FIG. 2, and a charger 22 that charges the image carrier 21. Furthermore, the toner image former 20 for each color includes an exposure device 23 that forms an electrostatic latent image on the image carrier 21 by exposing the image carrier 21 charged by the charger 22, and a developing device 24 that forms a toner image by developing the electrostatic latent image formed on the image carrier 21 by the exposure device 23.

In this configuration, the toner image former 20 for each color forms a toner image of the color using the toner for the color. Note that the details of the charger 22 will be described below.

Transfer Device 30

As illustrated in FIG. 1, the transfer device 30 includes a transfer belt 31 as an intermediate transfer body, first transfer rolls 33, and a transfer unit 35.

Transfer Belt 31

As illustrated in FIG. 1, the transfer belt 31 has an endless form, and is disposed to be wound over multiple rolls 32 and extend in the device up-down direction, and is in contact with the image carrier 21 of each color. The transfer belt 31 is circumferentially rotated by at least one of the multiple rolls 32 being rotationally driven in arrow B direction in FIG. 1.

First Transfer Roll 33

As illustrated in FIG. 1, each first transfer roll 33 is disposed on the opposite side of the transfer belt 31 from a corresponding image carrier 21 of a color. As illustrated in FIG. 2, the first transfer roll 33 transfers a toner image formed on the image carrier 21 to the transfer belt 31 at a first transfer position T between the image carrier 21 and the first transfer roll 33.

Transfer Unit 35

As illustrated in FIG. 1, the transfer unit 35 is disposed at a portion on the lower side of the transfer belt 31, and includes a second transfer roll 34, and an opposing roll 36. The opposing roll 36 is disposed on the opposite side of the transfer belt 31 from the second transfer roll 34 in the device up-down direction.

In this configuration, the first transfer roll 33 transfers a toner image formed on the image carrier 21 to the transfer belt 31 at the first transfer position T by an electrostatic force generated by the first transfer roll 33. Furthermore, the transfer belt 31 circumferentially rotates, thereby transporting the first transferred toner image to a second transfer position NT. In addition, the transfer unit 35 transfers the toner image transferred on the transfer belt 31 to the sheet member P passing through the second transfer position NT by an electrostatic force generated by the second transfer roll 34.

Transport Mechanism 60

As illustrated in FIG. 1, the transport mechanism 60 is disposed on the lower side of the image former 12 in the device up-down direction. The transport mechanism 60 includes delivery rolls 62, transport rolls 64, and a chain gripper 66.

Delivery Roll 62, Transport Roll 64

The delivery rolls 62 are each disposed to come into contact with the leading edge of a sheet member P stored in the storage unit 50 so as to deliver the sheet member P. Each delivery roll 62 is configured to deliver the sheet member P to a transport path 54 along which the sheet member P is transported.

Multiple transport rolls 64 are provided, and disposed side by side in the device width direction downstream in the transport direction of the sheet member P with respect to the delivery rolls 62. The transport rolls 64 are configured to receive the sheet member P delivered to the transport path 54 by the delivery rolls 62, and to transport the received sheet member P to the chain gripper 66.

Chain Gripper 66

Figure 3:
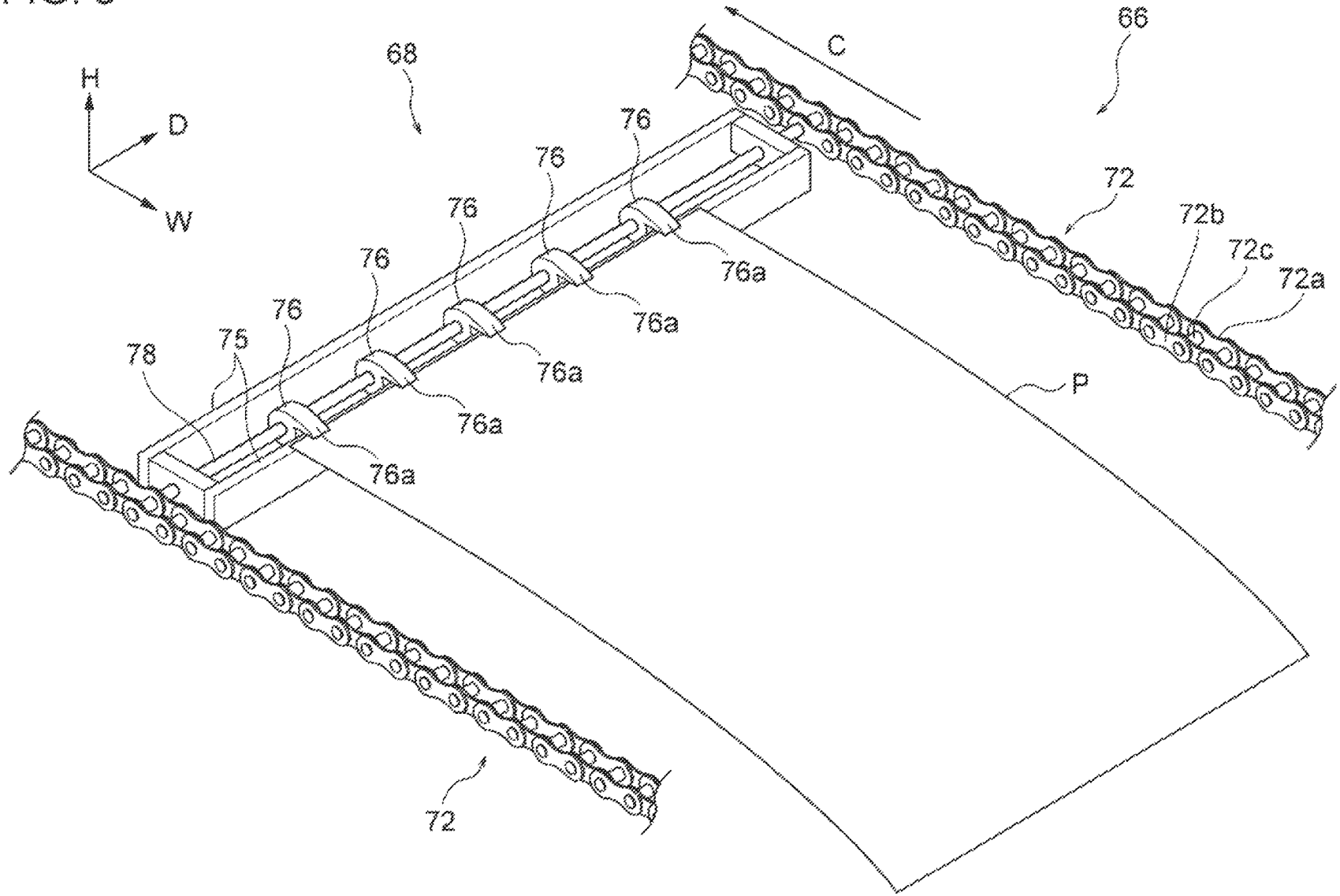
FIG. 3 is a perspective view illustrating a chain gripper included in the image forming apparatus according to the exemplary embodiment of the present disclosure.
Figure 4:
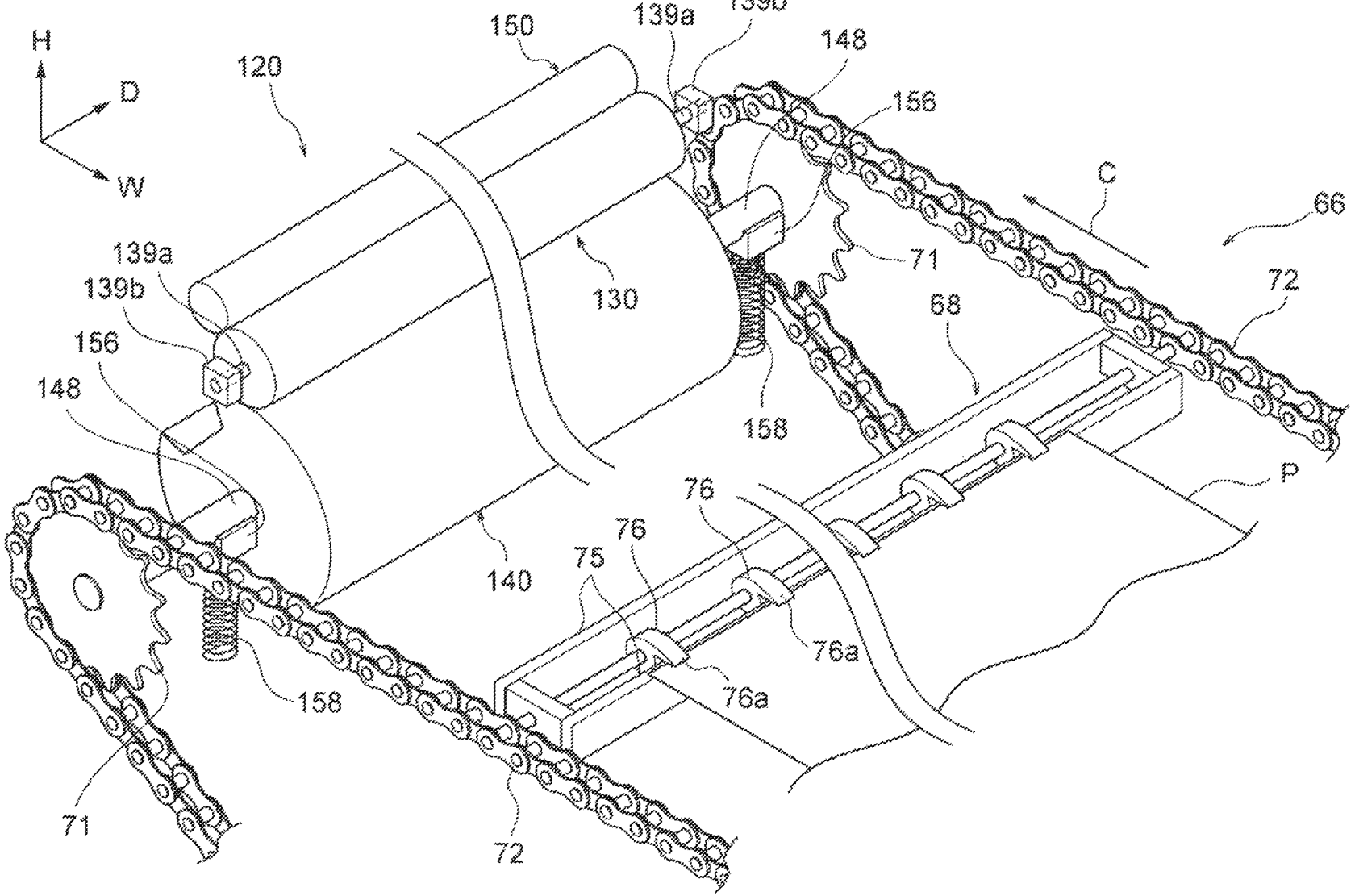
FIG. 4 is a perspective view illustrating a fixing unit and other components included in the image forming apparatus according to the exemplary embodiment of the present disclosure.

The chain gripper 66 is disposed on the other side of the transport rolls 64 in the device width direction. As illustrated in FIG. 3, FIG. 4, the chain gripper 66 includes a pair of chains 72 and a gripping unit 68.

Chain 72

A pair of chains 72 are provided, and disposed at intervals in the device depth direction as illustrated in FIG. 3. Furthermore, each chain 72 is formed in an endless form, and includes multiple outer plates 72*a* made of metal, multiple inner plates 72*b* made of metal, and pins 72*c* for connecting the outer plates 72*a* and the inner plates 72*b*. The pair of chains 72 illustrated in FIG. 1 are wound over a pair of sprockets (not illustrated) disposed on both sides of the opposing roll 36, a pair of sprockets 71 (see FIG. 4) disposed on both sides of the later-described pressure roll 140, and a pair of sprockets 74 disposed at intervals in the device depth direction.

Specifically, the pressure roll 140 having the sprockets 71 on both sides is disposed on the other side of the chains 72 from the opposing roll 36 in the device width direction as illustrated in FIG. 1. Furthermore, the pair of sprockets 74 are disposed on one side of the opposing roll 36 in the device width direction, and on the lower side of the opposing roll 36 in the device up-down direction. The pair of chains 72 are wound over these sprockets. Rotation of one of those pairs of sprockets causes the chains 72 to circumferentially rotate in the arrow C direction.

Gripping Unit 68

Multiple gripping units 68 are provided, and disposed at predetermined intervals in the circumferential direction of the chains 72 as illustrated in FIG. 1. As illustrated in FIG. 3, each gripping unit 68 includes: mounting members 75 which extend in the device depth direction, and both ends of which are respectively mounted on the pair of chains 72; an axial member 78 which is disposed inside the mounting members 75, and extends in the device depth direction; and grippers 76 mounted on the axial member 78 as gripping members.

Figure 5:
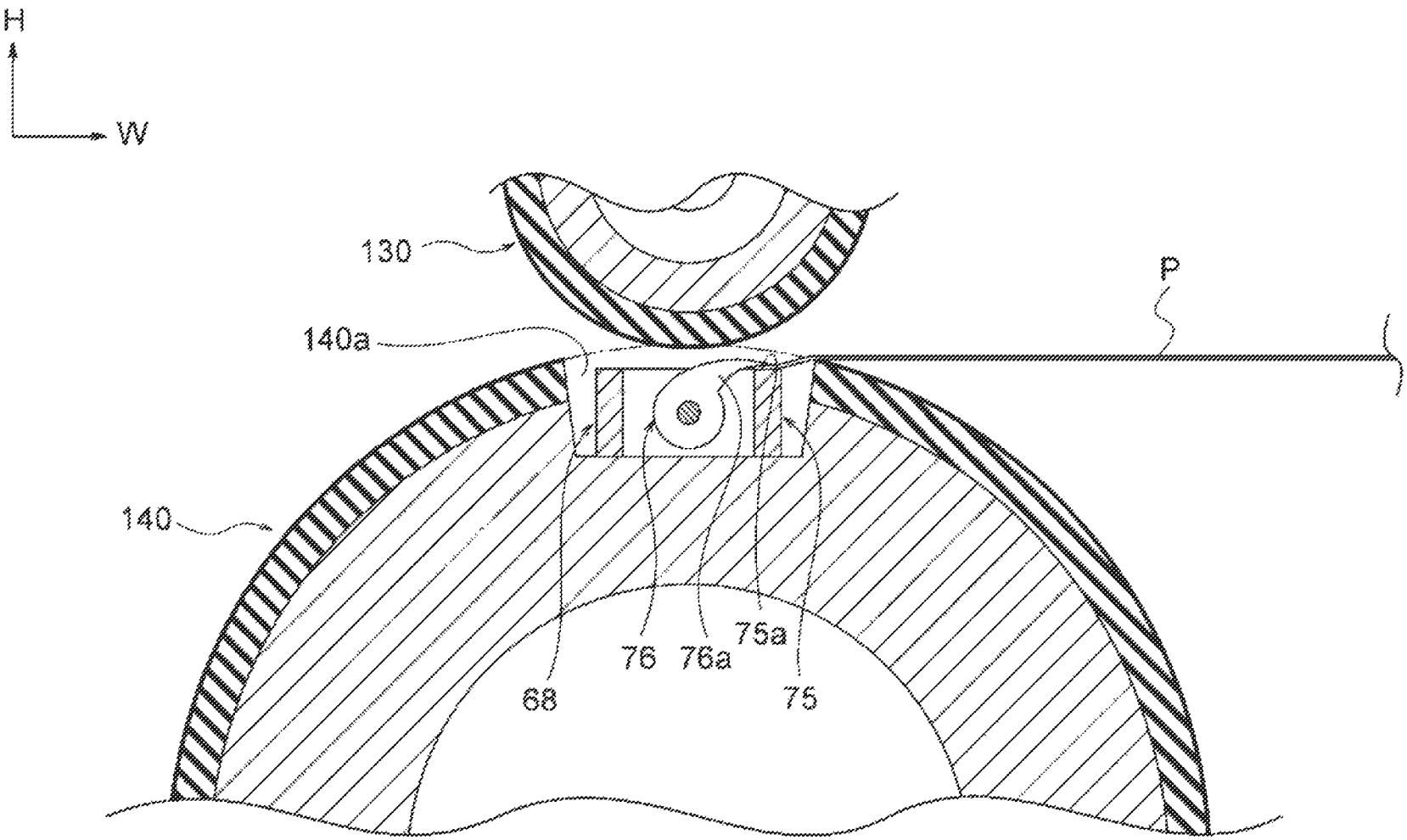
FIG. 5 is a cross-sectional view illustrating the fixing unit included in the image forming apparatus according to the exemplary embodiment of the present disclosure.

Multiple grippers 76 are provided, and mounted on the axial member 78 at predetermined intervals in the device depth direction. Furthermore, each of the grippers 76 has a nail 76*a*, and as illustrated in FIG. 5, the mounting members 75 include contact sections 75*a* with which corresponding nails 76*a* are to come into contact.

Each gripper 76 is configured to grip the sheet member P by gripping the leading edge of the sheet member P between the nail 76*a* and the contact section 75*a*. Thus, the gripper 76 has a function of gripping the leading edge of the sheet member P. In the gripper 76, for example, the nail 76*a* is pressed against the contact section 75*a* by a spring or the like, as well as the nail 76*a* is brought into contact with or separated from the contact section 75*a* by an operation of a cam or the like.

In this configuration, in the chain gripper 66, the grippers 76 receive the sheet member P transported by the transport rolls 64, and grip the leading edge of the sheet member P. Furthermore, the chain gripper 66 transports the sheet member P with the leading edge gripped by the grippers 76 to the second transfer position NT. In addition, the chain gripper 66 causes the sheet member P to pass through the later-described pre heater 102, then transports the sheet member P to a fixing unit 120.

Fixing Section 100

Figure 6:
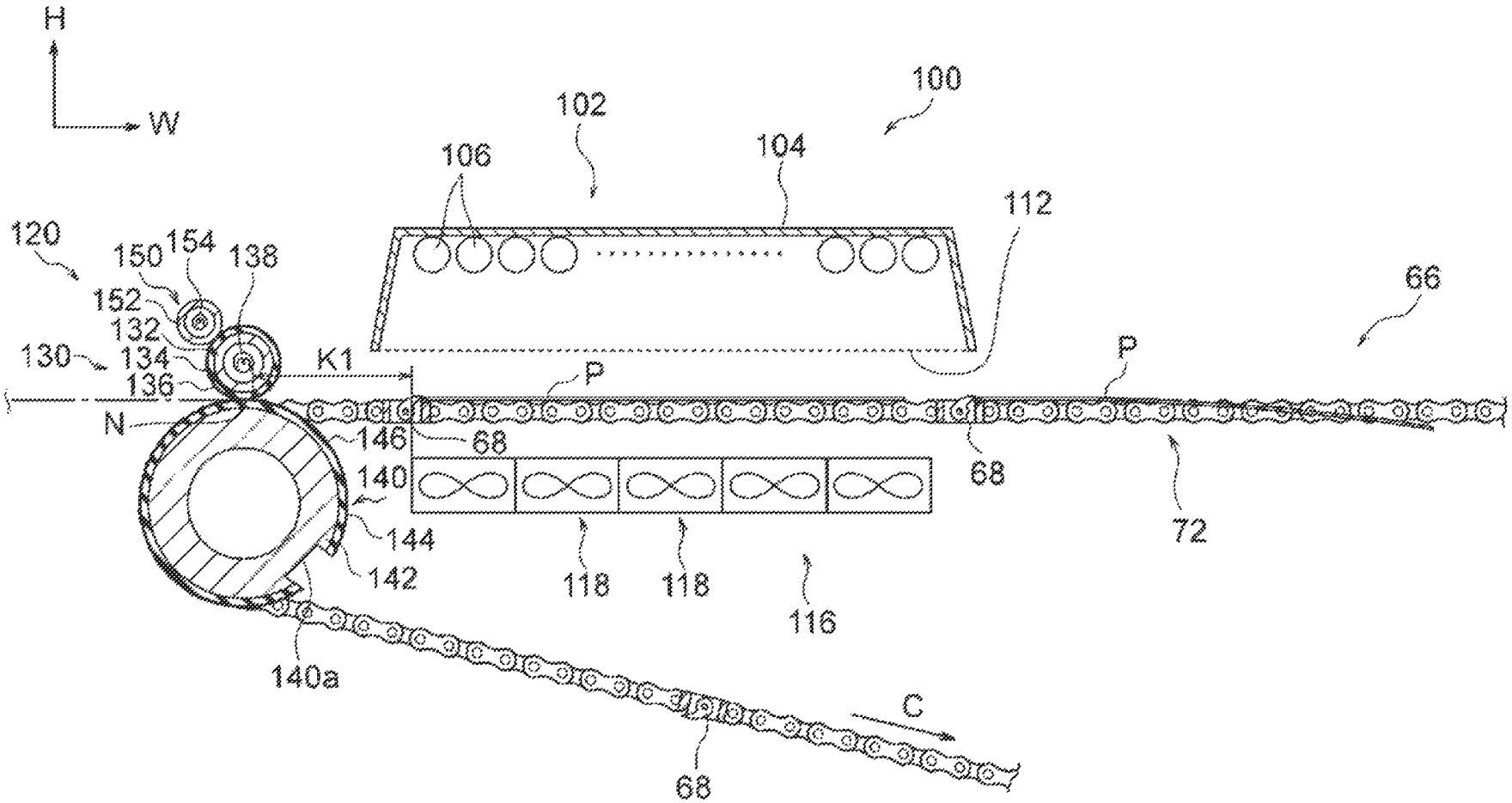
FIG. 6 is a front view illustrating a fixing section and other components included in the image forming apparatus according to the exemplary embodiment of the present disclosure.

As illustrated in FIG. 1, the fixing section 100 is disposed downstream of the second transfer position NT in the transport direction of the sheet member P. As illustrated in FIG. 6, the fixing section 100 includes a pre heater 102, an air blower 116, and a fixing unit 120. The fixing section 100 is an example of a heat source.

Pre Heater 102

As illustrated in FIG. 6, the pre heater 102 is disposed on the upper side of the chains 72, and includes multiple heaters 106 which are infrared heaters, a reflective plate 104 having the heaters 106 disposed internally, and a wire mesh 112.

Reflective Plate 104

The reflective plate 104 has a box shape with the lower side open so that infrared rays from the heaters 106 are reflected in a downward direction.

Heater 106

The heaters 106 are each a cylindrical infrared heater extending in the device depth direction, and are arranged side by side inside the reflective plate 104 in the device width direction.

Wire Mesh 112

The wire mesh 112 is fixed to the rim of the downward opening of the reflective plate 104. Thus, the wire mesh 112 separates the inside of the reflective plate 104 and the outside of the reflective plate 104. Thus, the wire mesh 112 prevents the sheet member P transported by the chain gripper 66 from coming into contact with the heaters 106.

Air Blower 116

Figure 7:
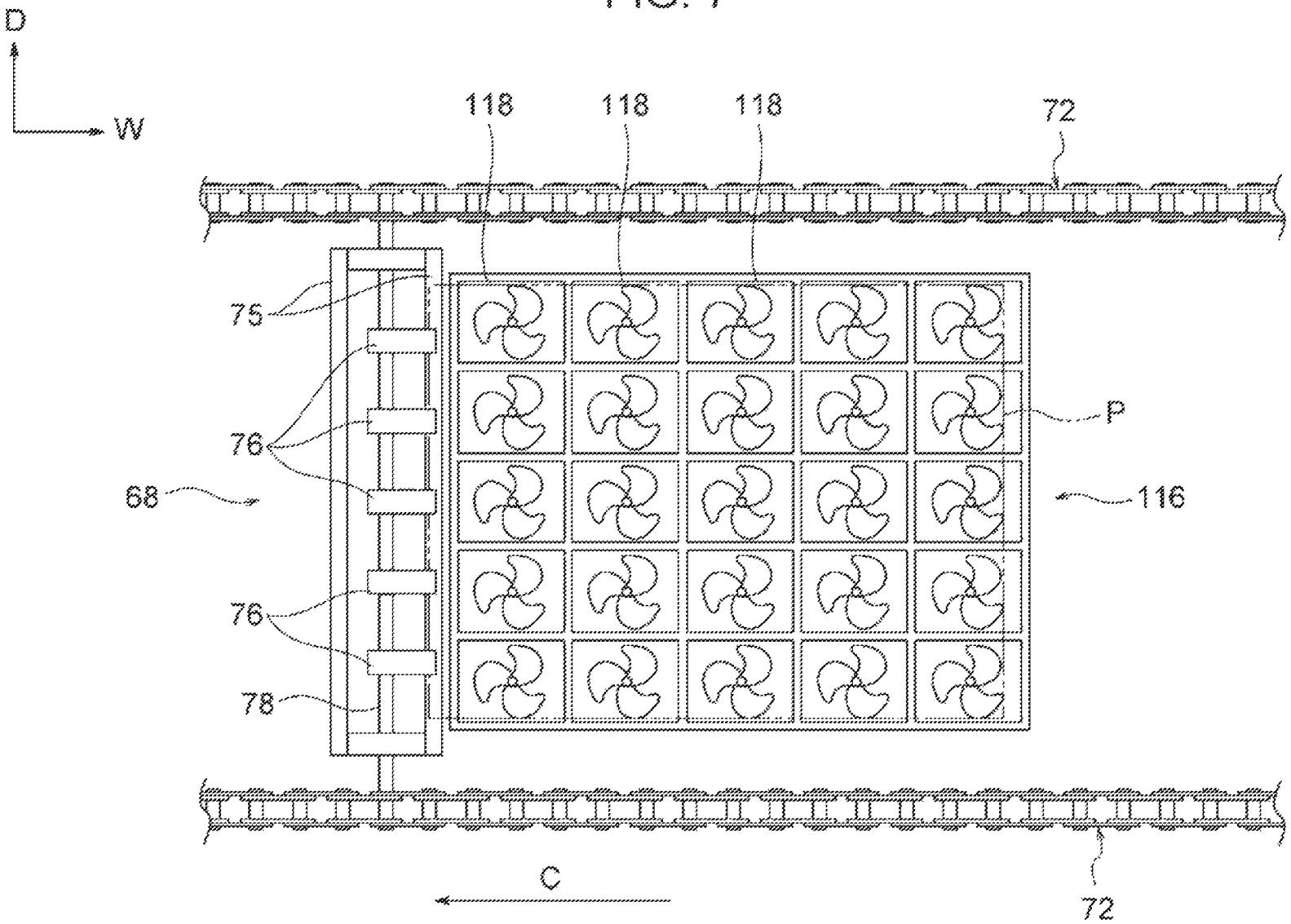
FIG. 7 is a plan view illustrating a pre heater included in the image forming apparatus according to the exemplary embodiment of the present disclosure.

As illustrated in FIG. 6, the air blower 116 is disposed to be opposed to the pre heater 102 with the chains 72 interposed therebetween in the device up-down direction. As illustrated in FIG. 7, the air blower 116 includes multiple fans 118 arranged side by side in the device width direction and in the device depth direction.

In this configuration, the multiple fans 118 blow air to the sheet member P transported by the chain gripper 66, thereby stabilizing the posture of the transported sheet member P. In this manner, the fans 118 each function as a posture stabilizing unit to stabilize the posture of the transported sheet member P.

Fixing Unit 120

As illustrated in FIG. 6, the fixing unit 120 is disposed downstream of the pre heater 102 in the transport direction of the sheet member P. The fixing unit 120 is to come into contact with the transported sheet member P, and to heat and fix a toner image on the sheet member P.

The fixing unit 120 includes a heating roll 130 that comes into contact with the transported sheet member P to heat a toner image, and a pressure roll 140 that applies pressure to the sheet member P on the heating roll 130. In addition, the fixing unit 120 includes a driven roll 150 that is driven to rotate by the heating roll 130 which rotates.

Heating Roll 130

As illustrated in FIG. 6, the heating roll 130 is disposed to come into contact with the upward surface of the transported sheet member P, and to extend in the device depth direction which is the axial direction. The heating roll 130 includes a cylindrical base material 132, a rubber layer 134 formed to cover the entire circumference of the base material 132, a release layer 136 formed to cover the entire circumference of the rubber layer 134, and a heater 138 stored inside the base material 132.

As illustrated in FIG. 4, both ends of the heating roll 130 in the device depth direction are provided with shafts 139*a* extending in the device depth direction, and support members 139*b* that respectively support the shafts 139*a*. Thus, the heating roll 130 is rotatably supported by the support members 139*b* at both ends of the heating roll 130.

Driven Roll 150

As illustrated in FIG. 6, the driven roll 150 is disposed on the opposite side of the heating roll 130 from the transported sheet member P, and extends in the device depth direction which is the axial direction. The driven roll 150 has a cylindrical base material 152, and a heater 154 stored inside the base material 152.

In this configuration, the driven roll 150 is driven to rotate by the heating roll 130. The driven roll 150 then heats the heating roll 130. In this manner, heating the heating roll 130 by the driven roll 150, and the heater 138 included in the heating roll 130 itself cause the surface temperature of the heating roll 130 to reach a predetermined temperature higher than or equal to 180 [° C.] and lower than or equal to 200 [° C.].

Pressure Roll 140 and Others

As illustrated in FIG. 6, the pressure roll 140 is disposed to come into contact with the downward surface of the transported sheet member P, on the opposite side of the transported sheet member P from the heating roll 130, and to extend in the device depth direction which is the axial direction. The pressure roll 140 includes a cylindrical base material 142, a rubber layer 144 formed to cover the base material 142, a release layer 146 formed to cover the rubber layer 144, and a pair of shafts 148 (see FIG. 4) formed at both ends in the device depth direction.

As illustrated in FIG. 5, a recess 140*a* is formed in the outer circumferential surface of the pressure roll 140, the recess 140*a* extending in the device depth direction. A gripping unit 68 gripping the leading edge of a sheet member P is stored in the recess 140*a* when the sheet member P passes between the pressure roll 140 and the heating roll 130.

As illustrated in FIG. 4, a pair of shafts 148 are formed at both ends in the device depth direction, and extend in the axial direction with a diameter smaller than the diameter of the outer circumferential surface of the release layer 146 in the pressure roll 140.

As illustrated in FIG. 4, the fixing unit 120 includes support members 156 that support the pressure roll 140, and urging members 158 that urge the pressure roll 140 toward the heating roll 130 via the support members 156. A pair of support members 156 are provided. The pair of support members 156 are respectively disposed so as to rotatably support the pair of shafts 148 of the pressure roll 140 from below.

The urging members 158 are compression springs provided as a pair, and disposed on the opposite side of the support members 156 from the shafts 148.

In this configuration, the pair of urging members 158 urge the pressure roll 140 toward the heating roll 130. In addition, the pressure roll 140, which rotates due to a rotational force transmitted thereto from a drive member (not illustrated), applies pressure to the sheet member P on the heating roll 130.

Furthermore, the heating roll 130 is driven to rotate by the pressure roll 140 in rotation, and the driven roll 150 is driven to rotate by the heating roll 130 in rotation. The sheet member P with a transferred toner image is interposed and transported between the heating roll 130 and the pressure roll 140, thus the toner image is fixed on the sheet member P.

Exhaust Device 160

Figure 9:
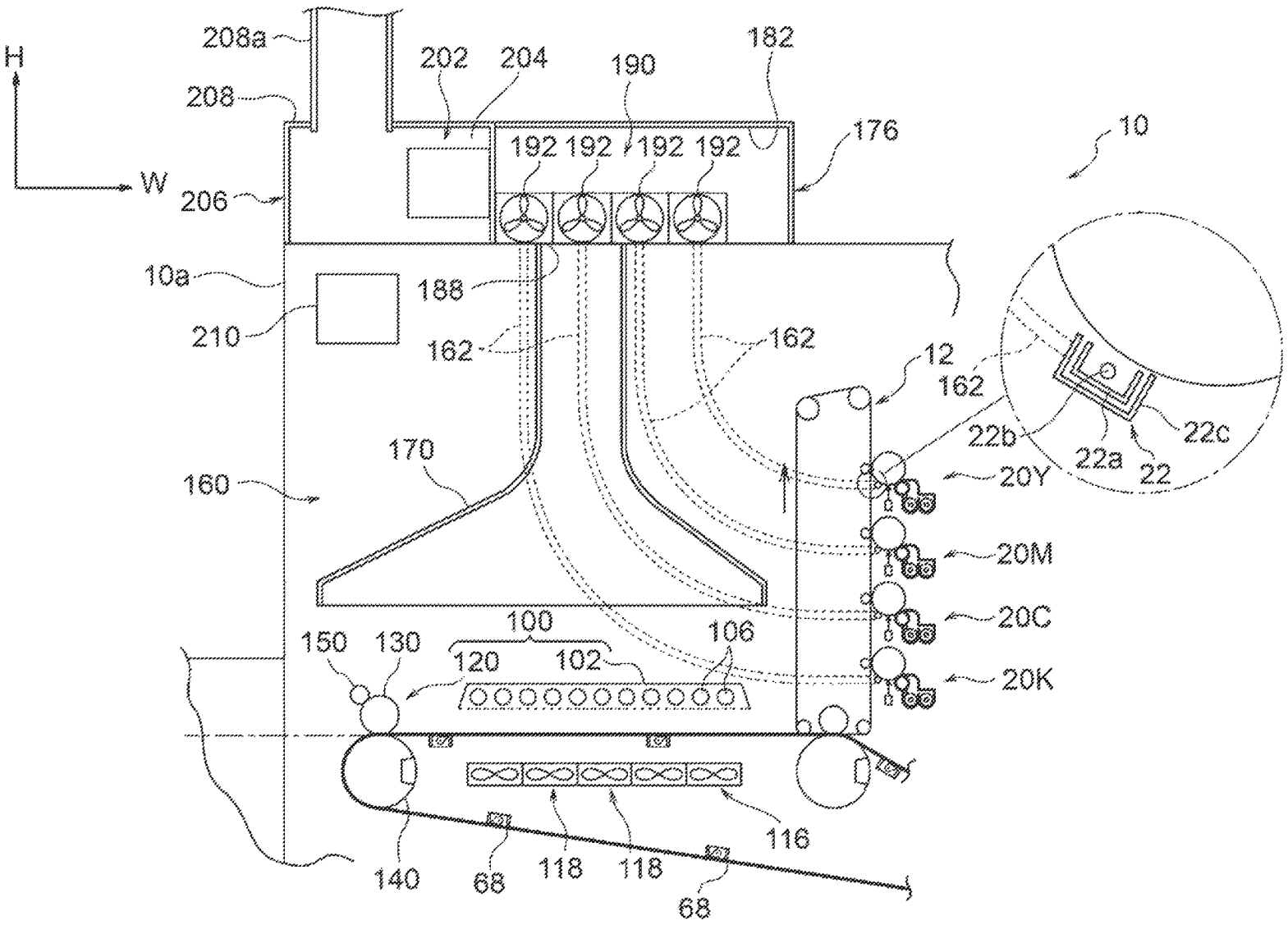
FIG. 9 is a front view illustrating the exhaust device according to the exemplary embodiment of the present disclosure.

As illustrated in FIG. 9, the exhaust device 160 is disposed above the fixing section 100. Note that the details of the exhaust device 160 will be described below.

Operation of Image Forming Apparatus 10

Next, the operation of the image forming apparatus 10 will be described.

The delivery rolls 62 illustrated in FIG. 1 deliver the sheet member P stored in the storage unit 50 to the transport path 54. Multiple transport rolls 64 receive and transport the sheet member P delivered to the transport path 54, and pass the sheet member P to the chain gripper 66. Thus, the chain gripper 66 transports the sheet member P to the second transfer position NT with the leading edge of the sheet member P gripped by the gripper 76. The transfer unit 35 transfers a toner image transferred on the transfer belt 31 to the sheet member P passing through the second transfer position NT, by an electrostatic force.

Furthermore, the chain gripper 66 transports the sheet member P so that the pre heater 102 and the sheet member P are opposed in the device up-down direction. Thus, the toner image transferred to the sheet member P is heated.

In addition, the chain gripper 66 transports the sheet member P with the toner image heated by the pre heater 102 to the fixing unit 120. The fixing unit 120 then fixes the toner image on the sheet member P.

Furthermore, the chain gripper 66 passes the sheet member P with the fixed toner image to the cooling roll 92 of the cooler 90. The cooling rolls 92 then transport the sheet member P while cooling it, and discharge the cooled sheet member P to the discharge unit 52.

Principal Component Configuration

Next, the charger 22, the exhaust device 160, and the control device 210 will be described.

Charger 22

The charger 22 is a corotron charger, and as illustrated in FIG. 2, includes a shield case 22*a* (hereinafter a "case 22*a*"), a corotron wire 22*b* (hereinafter a "wire 22*b*") disposed inside the case 22*a*, and a cover 22*c*.

Case 22*a*, Wire 22*b*

Figure 10:
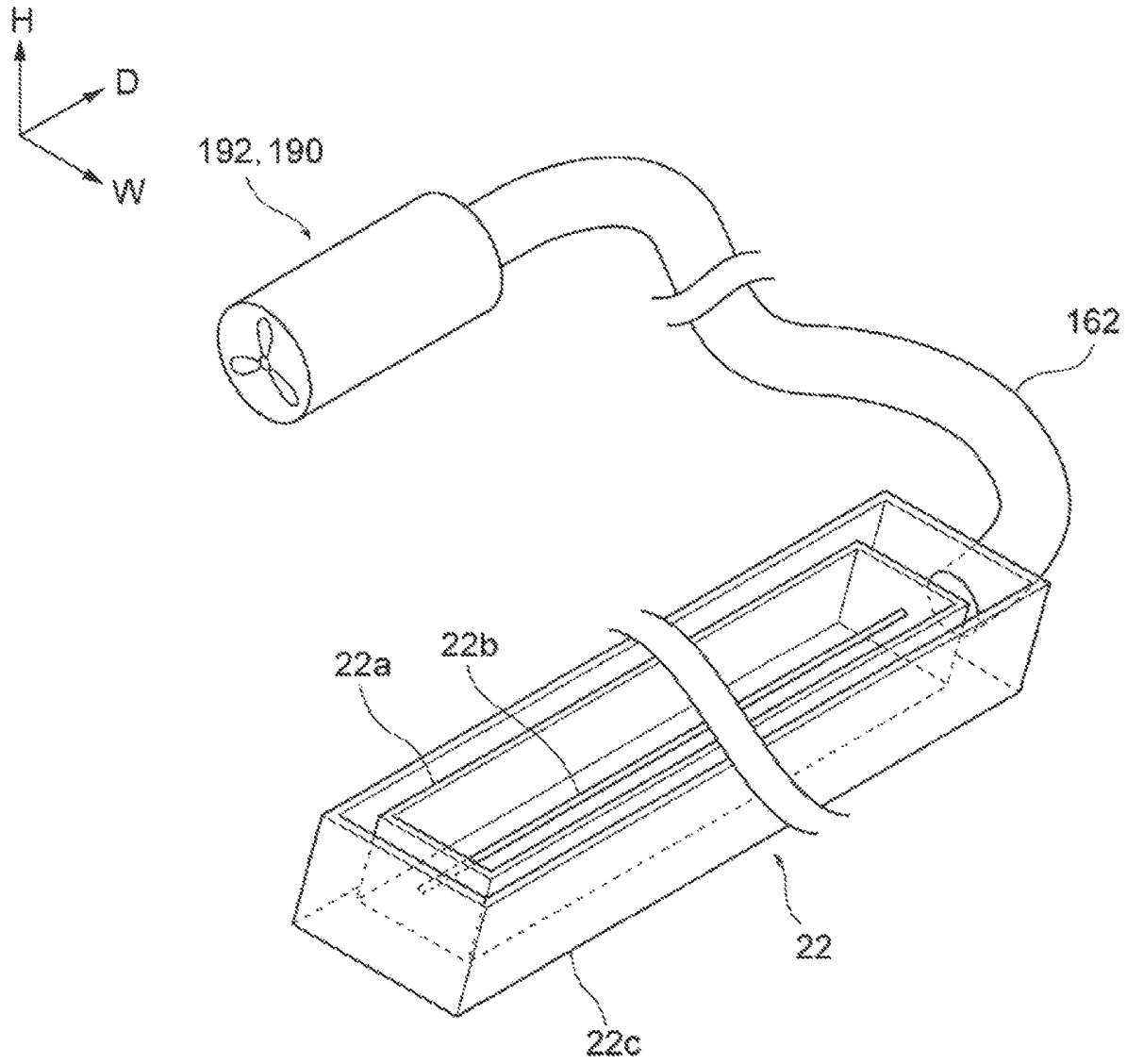
FIG. 10 is a configuration view illustrating an ozone flow path included in the exhaust device according to the exemplary embodiment of the present disclosure.

The case 22*a* is an aluminum case having an opening toward the image carrier 21, and extends in the device depth direction as illustrated in FIG. 10. The wire 22*b* is a tungsten wire which is disposed inside the case 22*a*, and extends in the device depth direction.

Cover 22*c*

The cover 22*c* has an opening toward the image carrier 21, and covers the case 22*a* from the outside as illustrated in FIG. 10.

In this configuration, a voltage is applied to the wire 22*b* to generate corona discharge, thus the charger 22 charges the image carrier 21. In addition, the cover 22*c* captures a gas containing ozone which is discharge product generated by the corona discharge.

Exhaust Device 160

As illustrated in FIG. 9, the exhaust device 160 includes an ozone flow path 162 through which a gas containing ozone flows, a hot gas flow path 170 through which a hot gas flows, and a joint section 176 where the gas containing ozone and the hot gas are joined. The exhaust device 160 further includes a first air flow generator 190 that generates an air flow in the ozone flow path 162, and a second air flow generator 202 that generates an air flow for causing a joint gas in which a gas containing ozone and a hot gas are joined to be discharged to the outside of the device body 10*a*. The ozone flow path 162 is an example of a flow path section.

Joint Section 176, Hot Gas Flow Path 170

Figure 8:
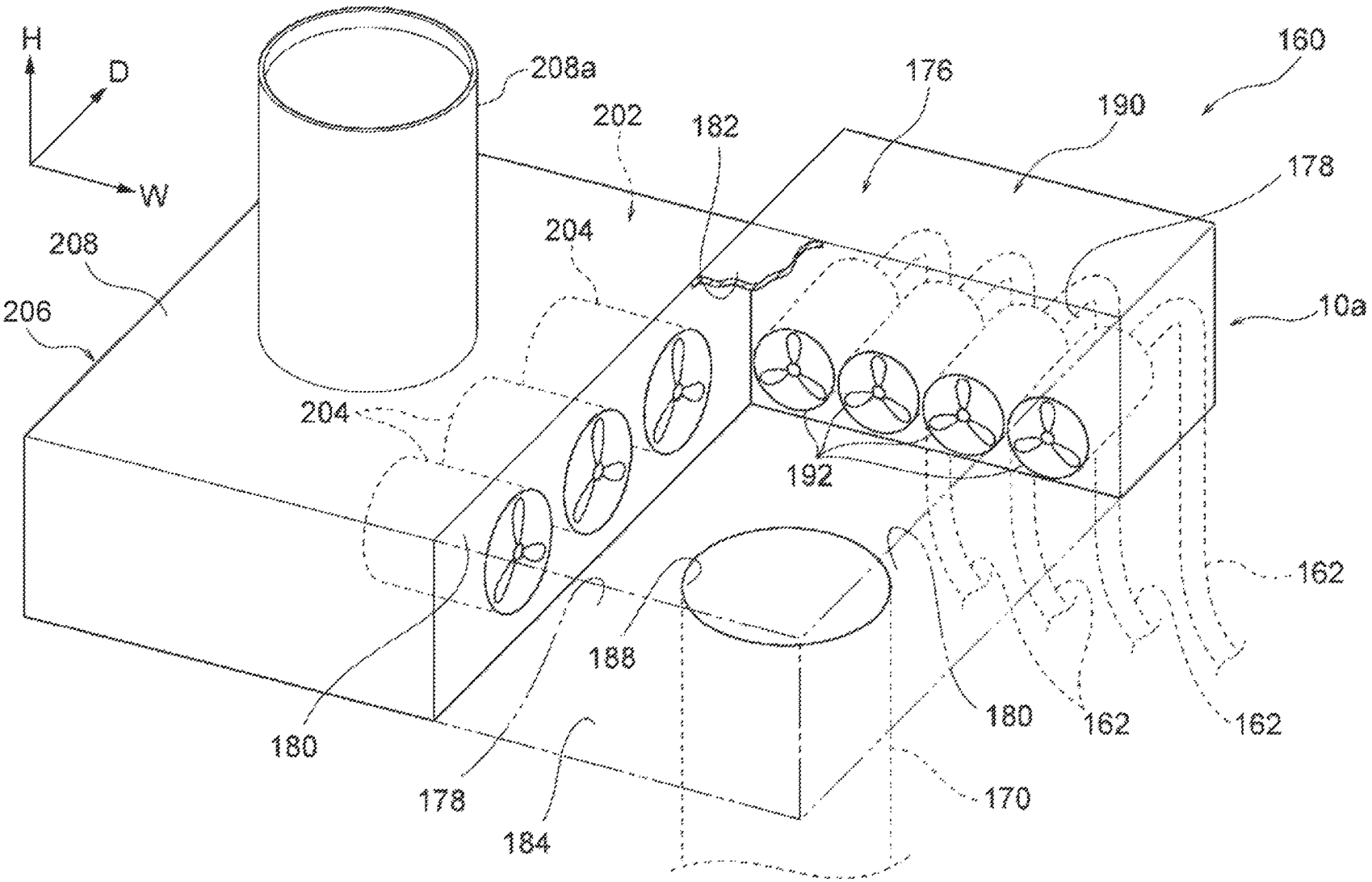
FIG. 8 is an enlarged perspective view illustrating part of an exhaust device according to the exemplary embodiment of the present disclosure.

As illustrated in FIG. 9, the joint section 176 is disposed above the fixing section 100 included in the image forming apparatus 10. As illustrated in FIG. 8, the joint section 176 includes: a pair of wall plates 178 spaced apart in the device depth direction which is the plate thickness direction; a pair of wall plates 180 spaced apart in the device width direction which is the plate thickness direction; a top plate 182; and a bottom plate 184. Consequently, a rectangular parallelepiped-shaped space is formed inside the joint section 176.

The bottom plate of the joint section 176 has an inlet opening 188 through which a hot gas heated by the fixing section 100 flows into the joint section 176. As illustrated in FIG. 9, the inlet opening 188 is disposed above the fixing section 100, and is opened so that a hot gas moving upward from the fixing section 100 flows into the joint section 176 through the inlet opening 188. Here, what is meant by the inlet opening 188 being disposed above the fixing section 100 is that as viewed in the device depth direction and in the device width direction, the inlet opening 188 is disposed above the area where the fixing section 100 is disposed.

In addition, what is meant by the inlet opening 188 being opened so that a hot gas moving upward flows into the joint section 176 through the inlet opening 188 is that the angle of inclination of the inlet opening 188 with respect to the horizontal direction may be greater than or equal to 60 degrees, it is more desirable that the angle of inclination be less than or equal to 30 degrees, and it is the most desirable that the angle of inclination be 0 degree (the inlet opening 188 is parallel to the horizontal direction). Note that in the present exemplary embodiment, the inlet opening 188 is parallel to the horizontal direction.

As illustrated in FIG. 9, the hot gas flow path 170 is disposed below the joint section 176 and above the fixing section 100. The hot gas flow path 170 has a cylindrical shape extending in the up-down direction, and the lower end portion of the hot gas flow path 170 expands like an inverted funnel having a diameter increasing with distance downward. The upper end of the hot gas flow path 170 is connected to the joint section 176 through the inlet opening 188.

First Air Flow Generator 190

As illustrated in FIG. 8, the first air flow generator 190 includes four fans 192. The fans 192 are each an axial flow fan, and arranged in the device width direction and mounted on the wall plate 178, on the far side, configurating the joint section 176 in the device depth direction. The wall plate 178 on which each fan 192 is mounted has an opening so that a gas caused by the operation of the fan 192 flows out to the joint section 176. Specifically, the gas caused by the operation of the fans 192 flows from the far side to the near side in the device depth direction, and flows out to the joint section 176.

Ozone Flow Path 162

The ozone flow path 162 is a pipe member, and four of them are provided. As illustrated in FIG. 10, one end of each ozone flow path 162 is connected to a wall section of the cover 22*c* of the charger 22. Thus, a gas containing the ozone captured by the cover 22*c* flows into the ozone flow path 162. As illustrated in FIGS. 8 to 10, the other end of the ozone flow path 162 is attached to a corresponding fan 192. In this manner, the other end of the ozone flow path 162 is connected to the joint section 176 through the fan 192.

In this configuration, the gas containing the ozone captured by the cover 22*c* due to the operation of the fans 192 flows through the ozone flow path 162, and flows out to the joint section 176.

Second Air Flow Generator 202 and Others

As illustrated in FIG. 8, the second air flow generator 202 includes three fans 204. The fans 204 are each an axial flow fan, and arranged in the device depth direction and mounted on the wall plate 180, on the other side (the left side in FIG. 8), included in the joint section 176 in the device width direction. The wall plate 180 on which each fan 204 is mounted has an opening so that a flowing gas caused by the operation of the fan 204 is discharged from the joint section 176. Specifically, a flowing gas caused by the operation of the fans 204 flows from one side to the other side in the device width direction, and is discharged from the joint section 176.

Three fans 204 are disposed inside a discharge unit 206 which is formed on the other side of the joint section 176 in the device width direction, and a top plate 208 included in the discharge unit 206 has a cylindrical passage flow path 208*a* through which a gas flows, the gas being discharged from the joint section 176 to the outside of the device body 10*a* by the fans 204.

Control Device 210

Figure 11:
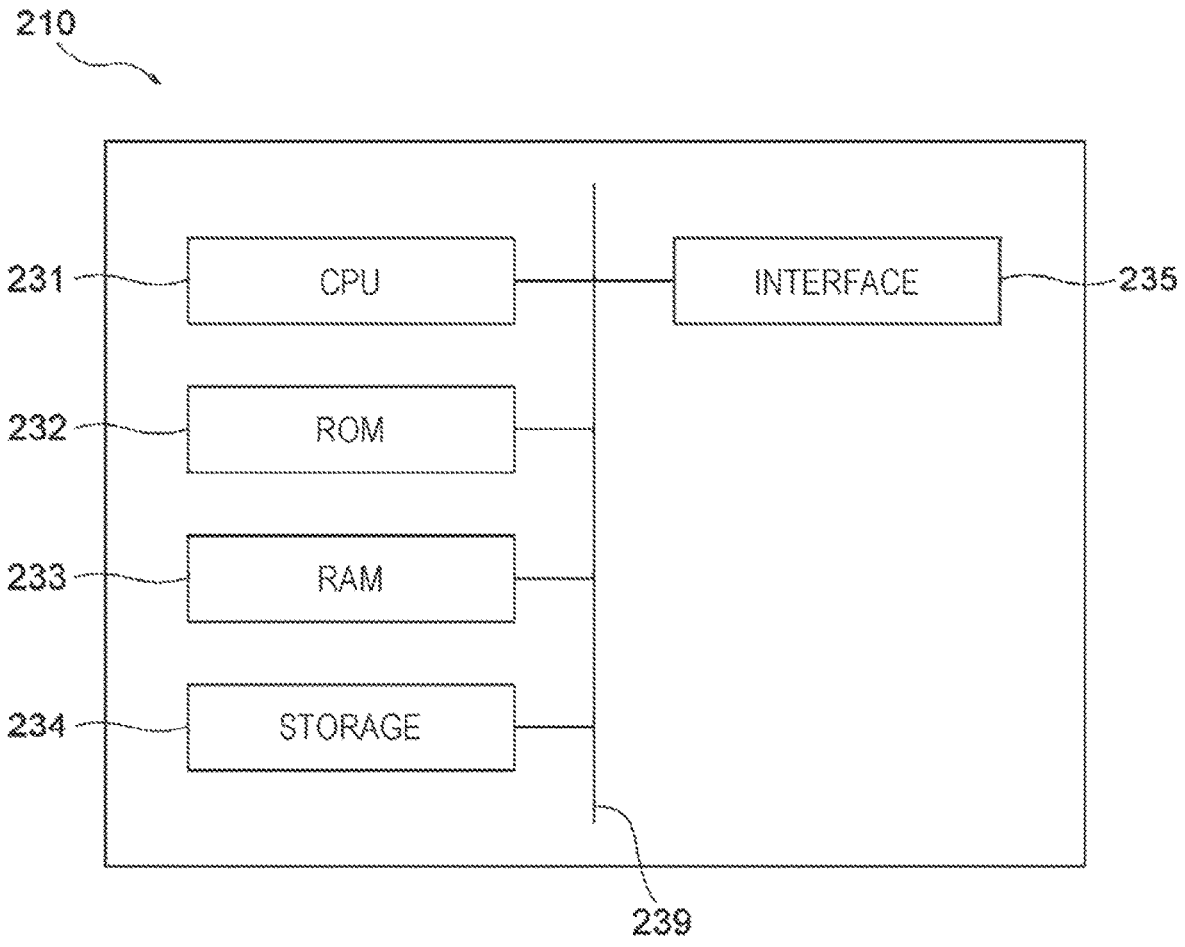
FIG. 11 is a diagram illustrating the hardware configuration of a control device included in the image forming apparatus according to the exemplary embodiment of the present disclosure.

As illustrated in FIG. 11, the control device 210 has a central processing unit (CPU) 231, a read only memory (ROM) 232, a random access memory (RAM) 233, a storage 234, and a communication interface (I/F) 235. The components are coupled to each other via a bus 239 to enable mutual communication.

The CPU 231 is a central arithmetic processing unit that executes various programs, and controls the components. Specifically, the CPU 231 reads a program from the ROM 232 or the storage 234, and executes the program using the RAM 233 as a work area. The CPU 231 controls the above-mentioned components and performs various types of arithmetic processing in accordance with a program recorded in the ROM 232 or the storage 234. In the present exemplary embodiment, the ROM 232 or the storage 234 stores an operation program that causes the fans 192 and the fans 204 to operate.

The ROM 232 stores various programs and various data. The RAM 233 serving as a work area temporarily stores programs or data. The storage 234 is comprised of a hard disk drive (HDD) or a solid state drive (SSD), and stores various programs including an operating system, and various data. The interface 235 is an interface of the control device 210 for connecting to the fans 192 and the fans 204.

The control device 210 controls the components of the image forming apparatus 10. As an example, the control device 210 is configured to obtain sheet type information from a storage unit (not illustrated) provided in the image forming apparatus 10 and operate the fans 204, the sheet type information being on the sheet member P on which an image is formed.

Note that the control of the components by the control device 210 will be described along with the operation of the principal component configuration described below.

Effect of Principal Component Configuration

Next, the effect of the principal component configuration will be described. The effect mentioned below is executed by the control device 210 controlling the components.

When the power supply of the image forming apparatus 10 is in an OFF state, the control device 210 sets the components including the fans 192 and the fans 204 to non-operational. When the power supply of the image forming apparatus 10 illustrated in FIG. 1 is set ON, the image forming apparatus 10 assumes a standby state.

Standby State

In a standby state, the control device 210 rotates the pressure roll 140 of the fixing section 100 of FIG. 9. Thus, the heating roll 130 and the driven roll 150 are rotated. In addition, the control device 210 heats the heating roll 130, and increases the surface temperature of the heating roll 130 so that the temperature of the surface of the heating roll 130 reaches a predetermined temperature. Note that the surface temperature of the heating roll 130 in a standby state is set to be lower than the surface temperature of the heating roll 130 in an image forming state in which an image is formed on the sheet member P.

Furthermore, the control device 210 causes the fans 204 of the second air flow generator 202 to operate. Thus, a hot gas generated due to the increase of the surface temperature of the heating roll 130 flows through the inlet opening 188 into the joint section 176, further flows through the passage flow path 208*a* from the joint section 176, and is discharged to the outside of the device body 10*a*.

Specifically, the hot gas generated due to the heating of the heating roll 130 flows along the hot gas flow path 170 and moves upward by the operation of the fans 204 illustrated in FIG. 9. The hot gas flows through the inlet opening 188 illustrated in FIG. 8 into the joint section 176. Specifically, the hot gas flows from the lower side to the upper side in the device up-down direction, and flows through the inlet opening 188 into the joint section 176. In this manner, the direction of flow of the hot gas into the joint section 176 is from the lower side to the upper side in the device up-down direction.

Furthermore, the hot gas, which has flowed into the joint section 176, flows through the passage flow path 208*a*, and is discharged from the joint section 176 to the outside of the device body 10*a*. Specifically, the hot gas flows from one side (the right side in FIG. 8) to the other side in the device width direction, and is discharged from the joint section 176 to the outside of the device body 10*a*. In this manner, the direction of discharge of the joint gas from the joint section 176 is from the one side to the other side in the device width direction. Note that in a standby state, the control device 210 sets the fans 204 to non-operational.

Furthermore, in order to form an image on the sheet member P, a user operates a user interface (not illustrated) provided in the image forming apparatus 10, thereby changing the image forming apparatus 10 from a standby state to an image forming state in which an image is formed on the sheet member P.

Image Forming State

When change is made from a standby state to an image forming state in which an image is formed on the sheet member P, the control device 210 causes the image former 12, the transport mechanism 60, and the cooler 90 illustrated in FIG. 1 to operate. In addition, the control device 210 heats the heater 106 of the fixing section 100 illustrated in FIG. 9, and causes the fans 118 to operate. The control device 210 further heats the heating roll 130 to increase the surface temperature of the heating roll 130 so that the surface of the heating roll 130 has an even higher temperature. Specifically, the control device 210 obtains from a storage unit (not illustrated) sheet type information on the sheet member P on which an image is formed. When the basis weight of the sheet member P is high, the control device 210 raises the surface temperature of the heating roll 130 to a level higher than the surface temperature of the heating roll 130 when the basis weight of the sheet member P is low.

The control device 210 then increases the number of rotations of the fans 204 of the second air flow generator 202. Specifically, when the basis weight of the sheet member P on which an image is formed is high, the control device 210 increases the number of rotations of the fans 204 to a level higher than the number of rotations when the basis weight of the sheet member P is low. In other words, when the surface temperature of the heating roll 130 is high, the control device 210 increases the number of rotations of the fans 204 to a level higher than the number of rotations when the surface temperature is low. That is, the control device 210 can change the flow rate of the joint gas which is discharged from the joint section 176 to the outside of the device body 10*a* by the second air flow generator 202. Consequently, the temperature increase inside the device body 10*a* is inhibited, and based on this, the power consumption of the fans 204 is controlled. Here, the flow rate is defined by volume per unit time, such as m3/min, for example, or by mass per unit time, such as kg/min, for example.

In addition, the control device 210 causes the fans 192 of the first air flow generator 190 illustrated in FIG. 9 to operate. Consequently, a gas containing ozone captured by the cover 22*c* flows through the ozone flow path 162, and flows out to the joint section 176, the ozone being generated by a charging operation of the charger 22 caused by an operation of the image former 12. Specifically, the gas containing ozone flows from the far side to the near side in the device depth direction, and flows out to the joint section 176. In this manner, the direction of flow out of the gas containing ozone to the joint section 176 is from the far side to the near side in the device depth direction.

Here, the control device 210 sets the number of rotations of the fans 192 to a predetermined value to maintain a constant flow rate of the gas containing ozone, which flows out from the charger 22 to the joint section 176 by the operation of the fans 192. The constant flow rate stabilizes the air flow around the wire 22*b*, and ozone is removed from the charger 22. Removal of ozone from the charger 22 reduces the occurrence of poor charging due to contamination of the wire 22*b*.

Here, the control device 210 controls the first air flow generator 190 and the second air flow generator 202 so that the flow rate of the hot gas discharged to the outside of the device body 10*a* becomes higher than the flow rate of the gas containing ozone discharged to the outside of the device body 10*a*.

Specifically, the control device 210 controls the first air flow generator 190 and the second air flow generator 202 so that the flow rate of the joint gas discharged from the joint section 176 to the outside of the device body 10*a* by the second air flow generator 202 becomes higher than the flow rate of the gas containing ozone flowing out to the joint section 176 by the first air flow generator 190. In other words, the control device 210 controls the first air flow generator 190 and the second air flow generator 202 so that the flow rate of the gas containing ozone flowing out to the joint section 176 by the first air flow generator 190 becomes lower than the flow rate of the joint gas discharged from the joint section 176 to the outside of the device body 10*a* by the second air flow generator 202. Consequently, the gas containing ozone is inhibited from stagnating inside the device body 10*a*. Note that the flow rate provided by the second air flow generator 202 is measured, for example, by attaching an ultrasonic flow meter to the outer periphery of the passage flow path 208*a*. In contrast, the flow rate provided by the first air flow generator 190 is measured, for example, by attaching an ultrasonic flow meter to the outer periphery of the ozone flow path 162.

Furthermore, when an image forming state in which an image is formed on the sheet member P is no longer assumed, the above-mentioned standby state is assumed, and the control device 210 sets the image former 12, the transport mechanism 60, and the cooler 90 illustrated in FIG. 1 to non-operational. In addition, the control device 210 sets the heater 106 and the fans 118 of the fixing section 100 illustrated in FIG. 9 to non-operational, and further reduces the surface temperature of the heating roll 130. When the power supply of the image forming apparatus 10 is set OFF, the control device 210 sets the fans 204 to non-operational.

General Overview

As described above, in the exhaust device 160, a gas containing ozone flows out to the joint section 176 into which a high heat gas flows. Furthermore, the flow rate of the joint gas discharged from the joint section 176 to the outside of the device body 10*a* by the second air flow generator 202 is set higher than the flow rate of the gas containing ozone flowing out to the joint section 176 by the first air flow generator 190. Consequently, the gas containing ozone is inhibited from stagnating inside the device body 10*a*, as compared with when a hot gas is joined to a flow path, at an intermediate point thereof, for discharging the gas containing ozone to the outside of the device body 10*a*.

In addition, in the exhaust device 160, a joint gas, in which a gas containing ozone and a hot gas are joined, is discharged from the joint section 176 to the outside of the device body 10*a*. Thus, a gas having a low ozone concentration is discharged to the outside of the device body 10*a*, as compared with when a gas containing ozone is discharged as it is to the outside of the device body.

In the exhaust device 160, the flow rate of the joint gas discharged from the joint section 176 to the outside of the device body 10*a* by the second air flow generator 202 is changeable, and the flow rate of the gas containing ozone flowing out to the joint section 176 by the first air flow generator 190 is maintained at a constant level. Consequently, the flow rate of a hot gas discharged to the outside of the device body 10*a* is adjusted.

In addition, in the exhaust device 160, when the surface temperature of the heating roll 130 is high, the control device 210 increases the number of rotations of the fans 204 to a level higher than the number of rotations when the surface temperature is low. Thus, the temperature increase inside the device body 10*a* is inhibited, and based on this, the power consumption of the fans 204 is controlled, as compared with when the number of rotations of the fans 204 of the second air flow generator 202 is constant.

In the exhaust device 160, the direction of flow out of the gas containing ozone to the joint section 176 by the first air flow generator 190 is from the far side to the near side in the device depth direction. In contrast, the direction of flow of the hot gas through the inlet opening 188 into the joint section 176 is from the lower side to the upper side in the device up-down direction. Consequently, variation in ozone concentration of the joint gas joined at the joint section 176 is reduced, as compared with when the direction of flow out and the direction of flow in are the same.

In the exhaust device 160, the direction of flow out and the direction of flow in intersect each other. Thus, variation in ozone concentration of the joint gas joined at the joint section 176 is reduced, as compared with when the direction of flow out is from the one side to the other side in one direction, and the direction of flow in is from the other side to the one side in one direction.

In the exhaust device 160, the direction of discharge in which the joint gas is discharged from the joint section 176 by the second air flow generator 202 is from the one side to the other side in the device width direction. In short, the direction of flow out, the direction of flow in, and the direction of discharge described above intersect each other. Thus, variation in ozone concentration of the joint gas discharged from the joint section 176 is reduced, as compared with when the direction of flow out, the direction of flow in, and the direction of discharge are the same.

In the exhaust device 160, a hot gas which moves upward flows through the inlet opening 188 into the joint section 176. Thus, a hot gas efficiently flows into the joint section 176, as compared with when a hot gas flows in a horizontal direction, and flows into the joint section.

In the exhaust device 160, the inlet opening 188 is disposed above the fixing section 100 which is a heat source for heating a gas. Therefore, a hot gas efficiently flows into the joint section 176, as compared with when the inlet opening is disposed above a region other than the area where the fixing section 100 is disposed in a horizontal direction.

In the image forming apparatus 10, the gas containing ozone is inhibited from stagnating inside the device body 10*a*, thus the occurrence of poor charging of the image carrier 21 is reduced. Thus, degradation of quality of the output image is inhibited, as compared with when the exhaust device 160 is not provided.

Although a specific exemplary embodiment of the present disclosure has been described in detail, the present disclosure is not limited to the exemplary embodiment, and it is apparent for those skilled in the art that various other exemplary embodiments are possible in the scope of the present disclosure. For example, in the exemplary embodiment, the exhaust device 160 includes the hot gas flow path 170; however, the exhaust device 160 may not include the hot gas flow path 170. It is sufficient that a hot gas flow through the inlet opening 188 into the joint section 176.

In the exemplary embodiment, the other end of the ozone flow path 162 is coupled to the joint section 176 via the fans 192; however, the other end of the ozone flow path 162 may be directly connected to the joint section 176. In this case, for example, the fans are disposed at an intermediate position of the ozone flow path.

In the exemplary embodiment, the direction of flow out and the direction of flow in intersect each other; however, those directions may not intersect each other. In this case, the effect achieved by the intersected directions is not achieved.

In the exemplary embodiment, the direction of flow out, the direction of flow in, and the direction of discharge described above intersect each other; however, those directions may not intersect each other. In this case, the effect achieved by the intersected directions is not achieved.

In the exemplary embodiment, a hot gas which moves upward flows through the inlet opening 188 into the joint section 176; however, a hot gas which moves in a horizontal direction may flow through the inlet opening into the joint section. However, in this case, the effect achieved by a hot gas moving upward and flowing through the inlet opening 188 into the joint section 176 is not achieved.

In the exemplary embodiment, a gas containing ozone is generated by the charger 22. However, for example, when a transfer unit is provided to transfer a toner image to a target object using corona discharge, a gas containing ozone generated by the transfer unit may be captured, and the gas containing the captured ozone may be discharged to the outside of the device body using the exhaust device 160. Consequently, transfer failure of a toner image is reduced, thus degradation of quality of the output image is inhibited.

Although description is not specifically provided, the joint gas may be discharged to the outdoors.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An exhaust device comprising:

a flow path section through which a gas containing ozone generated inside a device body flows;

a joint section which is connected to the flow path section, and has an inlet opening into which a hot gas generated inside the device body flows, the joint section being a section where the gas containing ozone and the hot gas are joined internally;

a first air flow generator that generates an air flow which causes the gas containing ozone to flow through the flow path section and flow out to the joint section; and a second air flow generator that generates an air flow which causes a joint gas in which the gas containing ozone and the hot gas are joined to be discharged from the joint section to an outside of the device body so that a flow rate of the joint gas discharged from the joint section to the outside of the device body is higher than a flow rate of the gas containing ozone flowing out to the joint section by the first air flow generator, wherein:

a direction of flow of the gas containing ozone into the joint section from the first air flow generator, a direction of flow of the hot gas through the inlet opening into the joint section, and a direction of discharge of the joint gas discharged from the joint section by the second air flow generator intersect each other, and a direction of flow out of a passage flowpath from the joint section to outside of the exhaust device is parallel to the direction of flow of the hot gas through the inlet opening into the joint section.

2. The exhaust device according to claim 1, further comprising:

a control device configured to change a flow rate of the joint gas which is discharged from the joint section to the outside of the device body by the second air flow generator, wherein the control device controls the second air flow generator to generate an air flow which causes the joint gas in which the gas containing ozone and the hot gas are joined to be discharged from the joint section to the outside of the device body so that the flow rate of the joint gas discharged from the joint section to the outside of the device body is higher than the flow rate of the gas containing ozone flowing out to the joint section by the first air flow generator.

3. The exhaust device according to claim 1, wherein the inlet opening is opened so that the hot gas flows through the inlet opening into the joint section.

4. The exhaust device according to claim 2, wherein the inlet opening is opened so that the hot gas flows through the inlet opening into the joint section.

5. The exhaust device according to claim 3, wherein the inlet opening is disposed above a heat source that heats a gas to generate the hot gas.

6. The exhaust device according to claim 4, wherein the inlet opening is disposed above a heat source that heats a gas to generate the hot gas.

7. An image forming apparatus comprising:

an image carrier;

a charger that charges the image carrier by an electric discharge;

an exposure that forms a latent image by exposing the charged image carrier;

a developer that forms an image by developing the latent image formed on the image carrier;

a transfer unit that transfers the image formed on the image carrier to a recording medium;

a fixing section, serving as a heat source, that heats the recording medium, and fixes the image on the recording medium; and the exhaust device according to claim 1, including the flow path section through which the gas containing ozone generated in the charger flows, and the joint section having the inlet opening into which the hot gas generated in the fixing section flows.

8. An image forming apparatus comprising:

an image carrier;

a charger that charges the image carrier by an electric discharge;

an exposure that forms a latent image by exposing the charged image carrier;

a developer that forms an image by developing the latent image formed on the image carrier;

a transfer unit that transfers the image formed on the image carrier by an electric discharge to a recording medium;

a fixing section, serving as a heat source, that heats the recording medium, and fixes the image on the recording medium; and the exhaust device according to claim 1, including the flow path section through which the gas containing ozone generated in the transfer unit flows, and the joint section having the inlet opening into which the hot gas generated in the fixing section flows.

* * * * *